US005927889A

United States Patent [19]

La Flower

[11] Patent Number: 5,927,889

[45] Date of Patent: Jul. 27, 1999

[54] MECHANIZED TOOTHBRUSH

[76] Inventor: Richard J. La Flower, 47 Annis Dr. #9, Gilford, N.H. 03246

[21] Appl. No.: 09/031,424

[22] Filed: Feb. 26, 1998

[51] Int. Cl.[6] ..... A46B 11/02; A46B 11/00

[52] U.S. Cl. ..... 401/268; 401/175; 401/269; 401/146; 401/171; 132/308; 132/309; 222/390

[58] Field of Search ..... 401/268, 175, 401/269, 146, 171; 222/390; 132/308, 309

[56] References Cited

U.S. PATENT DOCUMENTS

| | | | |
|---|---|---|---|
| 4,013,370 | 3/1977 | Gingras | 401/175 |
| 4,957,125 | 9/1990 | Yaneza | 401/175 |
| 5,289,835 | 3/1994 | Harlan et al. | 222/390 X |
| 5,762,239 | 6/1998 | Cossette | 222/390 X |

FOREIGN PATENT DOCUMENTS

| | | | |
|---|---|---|---|
| 142632 | 7/1951 | Australia | 401/175 |
| 356983 | 2/1938 | Italy | 401/175 |

*Primary Examiner*—Steven A. Bratlie

[57] ABSTRACT

An automatic dispensing toothbrush is provided including a toothpaste dispenser having a coaxial bore formed along a length thereof for housing toothpaste. A ball screw is rotatably coupled in concentric relationship within the bore of the toothpaste dispenser. A ball nut plunger is screwably coupled to the ball screw and adapted to raise within the toothpaste dispenser upon the rotation of the ball screw. A rotator is rotatably coupled within the bore of the toothpaste dispenser adjacent to a bottom thereof and further coupled to the ball screw for rotating the same. Also included is a toothbrush assembly including a hollow linear rod removably coupled to the toothpaste dispenser. The toothbrush assembly further includes a plurality of bristles extending horizontally from an upper extent of the hollow rod and at least one bore formed therein. The toothbrush assembly is threadedly coupleable to the toothpaste dispenser for receiving toothpaste therefrom.

10 Claims, 1 Drawing Sheet

MECHANIZED TOOTHBRUSH

BACKGROUND OF THE INVENTION

1. Field of the Invention

The present invention relates to toothbrush assemblies and more particularly pertains to a new mechanized toothbrush for automatically dispensing toothpaste from a toothbrush assembly with easily replaceable components.

2. Description of the Prior Art

The use of toothbrush assemblies is known in the prior art. More specifically, toothbrush assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrush assemblies include U.S. Pat. No. 4,145,147; U.S. Pat. No. 5,028,158; U.S. Pat. No. 4,291,995; U.S. Pat. No. 5,158,383; and U.S. Pat. No. Des. 301,401.

In these respects, the mechanized toothbrush according to the present invention substantially departs from the conventional concepts and designs of the prior art, and in so doing provides an apparatus primarily developed for the purpose of automatically dispensing toothpaste from a toothbrush assembly with easily replaceable components.

SUMMARY OF THE INVENTION

In view of the foregoing disadvantages inherent in the known types of toothbrush assemblies now present in the prior art, the present invention provides a new mechanized toothbrush construction wherein the same can be utilized for automatically dispensing toothpaste from a toothbrush assembly with easily replaceable components.

The general purpose of the present invention, which will be described subsequently in greater detail, is to provide a new mechanized toothbrush apparatus and method which has many of the advantages of the toothbrush assemblies mentioned heretofore and many novel features that result in a new mechanized toothbrush which is not anticipated, rendered obvious, suggested, or even implied by any of the prior art toothbrush assemblies, either alone or in any combination thereof.

To attain this, the present invention generally comprises a base having a rectangular configuration. As shown in FIG. 1, the base is equipped with a top face, a bottom face and four rectangular side walls. The top face has a cylindrical recess formed therein with a pair of contacts mounted on a bottom face thereof. The base further has an adapter outlet situated on one of the side walls.

Such adapter outlet is connected to the contacts for releasably connecting with a power source thereby providing power to the contacts. Situated on one of the side walls is a light connected to the adapter outlet for illuminating upon the connection with the power source. For allowing the interconnection of additional bases to the base, a plurality of L-shaped tabs are mounted on a pair of opposite side walls. Next provided is a battery with a cylindrical configuration. The battery has a pair of contacts mounted on a bottom face thereof which remain in communication with a pair of contacts mounted on a top face thereof. The battery is removably situated within the recess of the base such that the contacts of the bottom face of the battery are in communication with those of the base. By this structure, the base is adapted for recharging the battery upon the receipt of power.

With reference still to FIG. 1, a mechanized unit is provided having a cylindrical configuration. The mechanized unit is adapted to be mounted to the top face of the battery in a vertical orientation. The mechanized unit includes a coaxial bore formed therein along a length thereof. A motor is mounted within the bore adjacent to a bottom of the mechanized unit. Such motor has a pair of contacts on a bottom face thereof for communicating with those of the top face of the battery to receive power therefrom. A rotor of the motor has a gear with a frusto-conical configuration coupled thereto for rotating upon the receipt of power. The mechanized unit further includes a momentary push button switch situated on an outer surface thereof. The push button switch is connected between the motor and the contacts thereof for allowing power to be supplied to motor only during the depression thereof. A toothpaste dispenser is provided having a cylindrical configuration and including a coaxial bore formed along a length thereof for housing toothpaste. A lower extent of the toothpaste dispenser is equipped with an outer surface of a first diameter equal to that of the coaxial bore of the mechanized unit. As such, the toothpaste dispenser is adapted for being removably received within the mechanized unit. Associated therewith is an upper extent with a threaded outer surface of a second diameter less than the first diameter. A ball screw is rotatably coupled in concentric relationship within the bore of the toothpaste dispenser. Screwably coupled to the ball screw is a ball nut plunger which is adapted to raise within the toothpaste dispenser upon the rotation of the ball screw. A rotator is rotatably coupled within the bore of the toothpaste dispenser adjacent to a bottom thereof. The rotator is coupled to the ball screw and has a threaded frusto-conical recess formed in a bottom face thereof for engaging the gear of the motor of the mechanized unit. FIG. 1 also shows a toothbrush assembly including a hollow linear rod. Such linear rod has an upper portion of a third diameter less than the second diameter. A lower portion of the toothbrush assembly has a hollow threaded interior of the second diameter and an outer surface of the first diameter. A flared intermediate portion is situated between the upper and lower portions and has a lower periphery with a diameter equal to that of the mechanized unit. The toothbrush assembly further includes a plurality of bristles extending horizontally from an upper extent of the hollow rod. A plurality of dispensing bores are formed in the rod adjacent to bases of the bristles. By this structure, the toothbrush assembly is threadedly coupleable to the toothpaste dispenser for receiving toothpaste therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new mechanized toothbrush apparatus and method which has many of the advantages of the toothbrush assemblies mentioned heretofore and many novel features that result in a new mechanized toothbrush which is not anticipated, rendered obvious, suggested, or even implied by any of the prior art toothbrush assemblies, either alone or in any combination thereof.

It is another object of the present invention to provide a new mechanized toothbrush which may be easily and efficiently manufactured and marketed.

It is a further object of the present invention to provide a new mechanized toothbrush which is of a durable and reliable construction.

An even further object of the present invention is to provide a new mechanized toothbrush which is susceptible of a low cost of manufacture with regard to both materials and labor, and which accordingly is then susceptible of low prices of sale to the consuming public, thereby making such mechanized toothbrush economically available to the buying public.

Still yet another object of the present invention is to provide a new mechanized toothbrush which provides in the apparatuses and methods of the prior art some of the advantages thereof, while simultaneously overcoming some of the disadvantages normally associated therewith.

Still another object of the present invention is to provide a new mechanized toothbrush for automatically dispensing toothpaste from a toothbrush assembly with easily replaceable components.

Even still another object of the present invention is to provide a new mechanized toothbrush that includes a toothpaste dispenser having a coaxial bore formed along a length thereof for housing toothpaste. A ball screw is rotatably coupled in concentric relationship within the bore of the toothpaste dispenser. A ball nut plunger is screwably coupled to the ball screw and adapted to raise within the toothpaste dispenser upon the rotation of the ball screw. A rotator is rotatably coupled within the bore of the toothpaste dispenser adjacent to a bottom thereof and further coupled to the ball screw for rotating the same. Also included is a toothbrush assembly including a hollow linear rod removably coupled to the toothpaste dispenser. The toothbrush assembly further includes a plurality of bristles extending horizontally from an upper extent of the hollow rod and at least one bore formed therein. The toothbrush assembly is threadedly coupleable to the toothpaste dispenser for receiving toothpaste therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
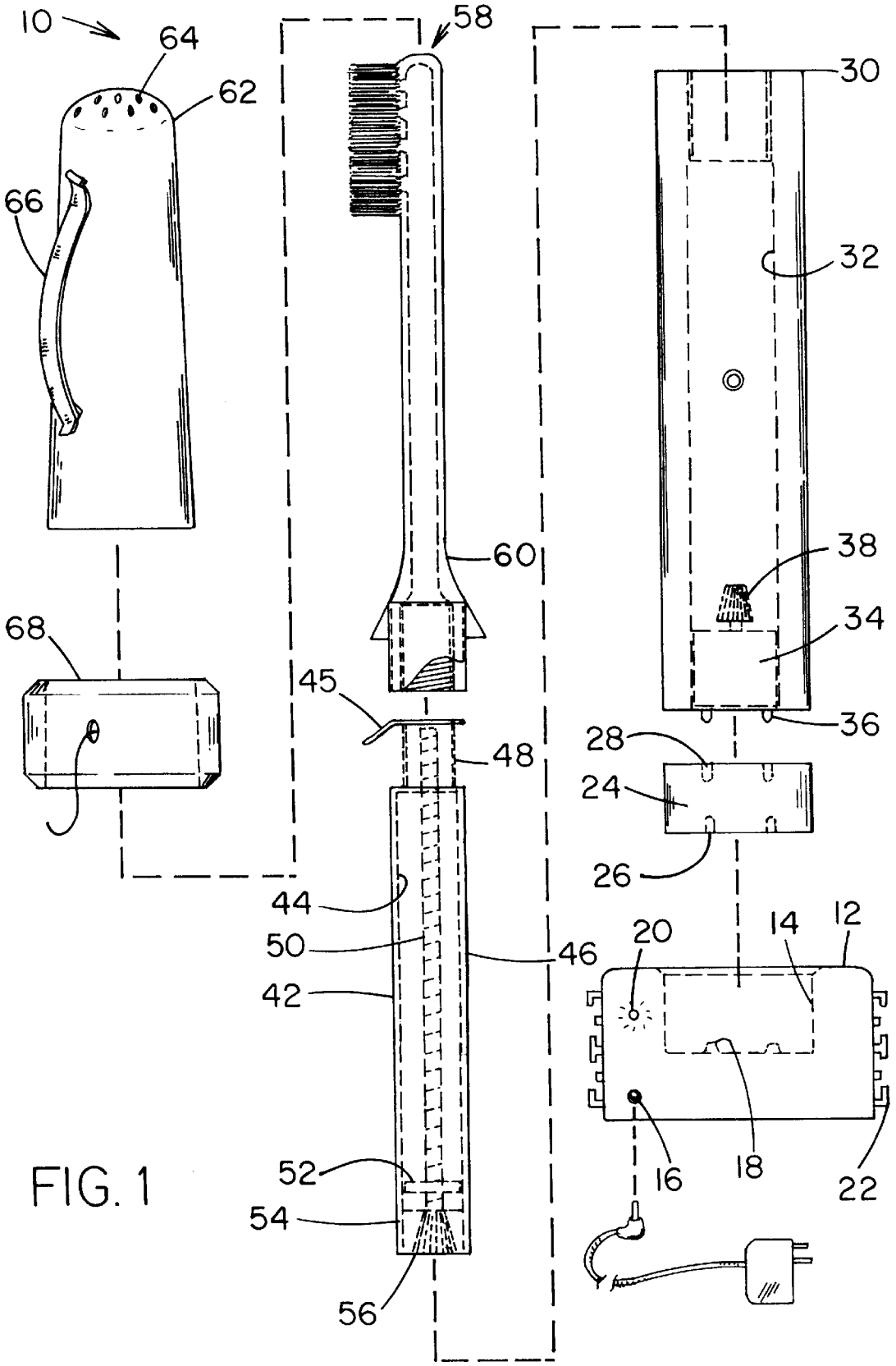
FIG. 1 is an exploded view of a new mechanized toothbrush according to the present invention.

With reference now to the drawings, and in particular to FIG. 1, a new mechanized toothbrush embodying the principles and concepts of the present invention and generally designated by the reference numeral 10 will be described.

The present invention, designated as numeral 10, includes a base 12 having a rectangular configuration. As shown in FIG. 1, the base is equipped with a top face, a bottom face and four rectangular side walls. The top face has a cylindrical recess 14 formed therein with a pair of contacts mounted on a bottom surface thereof. The base further has an adapter outlet 16 situated on one of the side walls. Such adapter outlet is connected to the contacts 18 for releasably connecting with a power source thereby providing power to the contacts. Situated on one of the side walls is a light 20 connected to the adapter outlet for illuminating upon the connection with the power source. For allowing the interconnection of additional bases to the aforementioned base, a plurality of L-shaped tabs 22 are mounted on an opposed pair of the side walls. The L-shaped tabs allow the coupling of the bases in horizontal alignment.

Next provided is a battery 24 with a cylindrical configuration. The battery has a pair of contacts 26 mounted on a bottom face thereof which remain in communication with a pair of contacts 28 mounted on a top face thereof. The battery is removably situated within the recess of the base such that the contacts of the bottom face of the battery are in communication with those of the base. By this structure, the base is adapted for recharging the battery upon the receipt of power.

With reference still to FIG. 1, a mechanized unit 30 is provided having a cylindrical configuration and a height at least twice that of the base. The mechanized unit is adapted to be mounted to the top face of the battery in a vertical orientation. The mechanized unit includes a coaxial bore 32 formed therein along a length thereof. A motor 34 is mounted within the bore adjacent to a bottom of the mechanized unit. Such motor has a pair of contacts 36 on a bottom face thereof for communicating with those of the top face of the battery to receive power therefrom. A rotor of the motor has a gear 38 with a frusto-conical configuration coupled thereto for rotating upon the receipt of power by the motor. The mechanized unit further includes an unillustrated momentary push button switch situated on an outer surface thereof. The push button switch is connected between the motor and the contacts thereof for allowing power to be supplied to motor only during its depression.

A toothpaste dispenser 42 is provided having a cylindrical configuration and length equal to that of the mechanized unit. The toothpaste dispenser includes a coaxial bore 44 formed along a length thereof for housing toothpaste. In the preferred embodiment, an open top of the toothpaste dispenser is equipped with a removable seal 45. A lower extent 46 of the toothpaste dispenser is equipped with an outer surface of a first diameter equal to that of the coaxial bore of the mechanized unit. As such, the toothpaste dispenser is adapted for being removably received within the mechanized unit. Above the lower extent is an upper extent 48 with a threaded outer surface of a second diameter less than the first diameter. As shown in FIG. 1, the upper extent of the toothpaste dispenser has a length which is less than ¼ that of the mechanized unit.

A ball screw 50 is rotatably coupled in concentric relationship within the bore of the toothpaste dispenser. Screwably coupled to the ball screw is a ball nut plunger 52 which is adapted to raise within the toothpaste dispenser upon the rotation of the ball screw. A rotator 54 is rotatably coupled within the bore of the toothpaste dispenser adjacent to a bottom thereof. The rotator is fixedly coupled to the ball screw and has a threaded frusto-conical recess 56 formed in a bottom face thereof for engaging the gear of the motor of the mechanized unit.

FIG. 1 also shows a toothbrush assembly 58 including a hollow linear rod. Such linear rod has an upper portion of a third diameter less than the second diameter. A lower portion of the toothbrush assembly has a hollow threaded interior of the second diameter and an outer surface of the first diameter. A flared intermediate portion 60 is situated between the upper and lower portions and has a lower periphery with a diameter equal to that of an outer surface of the mechanized unit.

The toothbrush assembly further includes a plurality of bristles extending horizontally from an upper extent of the hollow rod. A plurality of dispensing bores are formed in the rod adjacent to bases of the bristles. By this structure, the toothbrush assembly is threadedly coupleable to the toothpaste dispenser for receiving toothpaste therefrom. Further, the lower portion of the toothbrush assembly preferably has a threaded outer surface for being screwably coupled to a threaded top of the bore of the mechanized unit.

For selectively covering the toothbrush assembly, a cap 62 is provided having a tapered side wall and an arcuate top face. The top face is equipped with a plurality of vents 64 formed therein. The cap further includes a clip 66 coupled to the side wall and running in parallel with an axis of the cap.

Finally, a dental floss dispenser 68 is provided with an annular configuration. A side wall of the dental floss dispenser has an aperture formed therein for dispensing dental floss therefrom. The dental floss dispenser has a top end coupled to the open bottom end of the cap. In use, the cap and dental floss dispenser are removably situated over the toothbrush assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic dispensing toothbrush comprising, in combination:

a base having a rectangular configuration with a top face, a bottom face and four rectangular side walls, the top face having a cylindrical recess formed therein with a pair of contacts mounted on a bottom face thereof, the base including an adapter outlet situated on one of the side walls and connected to the contacts for releasably connecting with a power source thereby providing power to the contacts, a light situated on one of the side walls and connected to the adapter outlet for illuminating upon the connection with the power source, and a plurality of L-shaped tabs mounted on a pair of opposite side walls for interconnecting with additional bases;

a battery with a cylindrical configuration having a pair of contacts mounted on a bottom face thereof and further in communication with a pair of contacts mounted on a top face thereof, wherein the battery is removably situated within the recess of the base such that the contacts of the bottom face of the battery are in communication with those of the base for recharging the battery upon the receipt of power;

a mechanized unit having a cylindrical configuration and adapted to be mounted to the top face of the battery in a vertical orientation, the mechanized unit including a coaxial bore formed therein along a length thereof and a motor mounted within the bore adjacent to a bottom of the mechanized unit, the motor having a pair of contacts on a bottom face thereof for communicating with those of the top face of the battery to receive power therefrom and a rotator having a gear with a frusto-conical configuration coupled thereto for rotating upon the receipt of power, the mechanized unit further including a momentary push button switch situated on an outer surface thereof and connected between the motor and the contacts thereof for allowing power to be supplied to motor only during the depression thereof;

a toothpaste dispenser having a cylindrical configuration and including a coaxial bore formed along a length thereof for housing toothpaste, a lower extent with an outer surface of a first diameter equal to that of the coaxial bore of the mechanized unit for being removably received therein, an upper extent with a threaded outer surface of a second diameter less than the first diameter, a ball screw rotatably coupled in concentric relationship within the bore of the toothpaste dispenser, a ball nut plunger screwably coupled to the ball screw and adapted to raise within the toothpaste dispenser upon the rotation of the ball screw, and a rotator rotatably coupled within the bore of the toothpaste dispenser adjacent to a bottom thereof, the rotator being coupled to the ball screw and having a threaded frusto-conical recess formed in a bottom face thereof for engaging the gear of the motor of the mechanized unit;

a toothbrush assembly including a hollow linear rod with an upper portion of a third diameter less than the second diameter, a lower portion having a hollow threaded interior of the second diameter and an outer surface of the first diameter, and a flared intermediate portion having a lower periphery with a diameter equal to that of the mechanized unit, the toothbrush assembly further including a plurality of bristles extending horizontally from an upper extent of the hollow rod and a plurality of bores formed in the rod, whereby the toothbrush assembly is threadedly coupleable to the toothpaste dispenser for receiving toothpaste therefrom;

a cap having a tapered side wall, an arcuate top face with a plurality of vents formed therein and an open bottom, the cap further including a clip coupled to the side wall and running in parallel with an axis of the cap; and a dental floss dispenser with an annular configuration and a side wall having an aperture formed therein for dispensing dental floss therefrom, the dental floss dispenser having a top end coupled to the open bottom end of the cap, whereby the cap and dental floss dispenser are removably situated over the toothbrush assembly.

2. A toothbrush comprising:

a toothpaste dispenser adapted to dispense toothpaste;

a toothbrush assembly including a hollow rod coupled to the toothpaste dispenser, the toothbrush assembly further including a plurality of bristles extending horizontally from an upper extent of the hollow rod and at least one bore formed therein, whereby the toothbrush assembly is adapted for receiving toothpaste from the toothpaste dispenser:

a cap with an open bottom; and a dental floss dispenser with an annular configuration and a side wall having an aperture formed therein for dispensing dental floss therefrom, the dental floss dispenser having a top end coupled to the open bottom end of the cap, wherein the cap and dental floss dispenser are removably situated over the toothbrush assembly.

3. A toothbrush as set forth in claim 2 wherein the cap has a clip mounted thereon.

4. A toothbrush as set forth in claim 2 wherein the cap has a plurality of vents formed therein.

5. A toothbrush as set forth in claim 2 wherein further included is a mechanized unit with a motor mounted thereon, the toothpaste dispenser being removably mounted to the mechanized unit and in communication with the motor thereby allowing the mechanized dispensing of toothpaste from the toothpaste dispenser.

6. A toothbrush as set forth in claim 5 wherein the mechanized unit includes an elongated hollow bore for receiving the toothpaste dispenser.

7. A toothbrush as set forth in claim 5 wherein the mechanized unit has a switch mounted thereon for selectively actuating the motor.

8. An automatic dispensing toothbrush comprising:

a mechanized unit including a motor and a rotator having a gear with a frusto-conical configuration coupled thereto for rotating upon the receipt of power, the mechanized unit further including a switch connected between the motor and a power source for allowing power to be supplied to motor only during the closing thereof;

a toothpaste dispenser including a coaxial bore formed along a length thereof for housing toothpaste, a ball screw rotatably coupled in concentric relationship within the bore of the toothpaste dispenser, a ball nut plunger screwably coupled to the ball screw and adapted to raise within the toothpaste dispenser upon the rotation of the ball screw, and a rotator rotatably coupled within the bore of the toothpaste dispenser adjacent to a bottom thereof, the rotator being coupled to the ball screw and having a threaded frusto-conical recess formed in a bottom face thereof for releasably engaging the gear of the motor of the mechanized unit; and a toothbrush assembly including a hollow rod removably coupled to the toothpaste dispenser, the toothbrush assembly further including a plurality of bristles extending from an upper extent of the hollow rod and at least one bore formed therein, whereby the toothbrush assembly is coupleable to the toothpaste dispenser for receiving toothpaste therefrom.

9. An automatic dispensing toothbrush as set forth in claim 8 wherein the mechanized unit houses the toothpaste dispenser and is fixed in relation thereto, wherein the mechanized unit is removably coupled to the toothbrush assembly.

10. An automatic dispensing toothbrush as set forth in claim 8 wherein the toothpaste dispenser has an open top with a seal removably mounted thereon.

* * * * *